United States Patent [19]

Losert et al.

[11] 3,984,201

[45] Oct. 5, 1976

[54] LAUNDRY MACHINE AND METHOD OF WASHING CLOTHES

[75] Inventors: Gerhard K. Losert; Laddie A. DePas, both of Louisville, Ky.

[73] Assignee: General Electric Company, Louisville, Ky.

[22] Filed: July 23, 1975

[21] Appl. No.: 598,406

Related U.S. Application Data

[63] Continuation-in-part of Ser. No. 464,223, April 25, 1974, abandoned.

[52] U.S. Cl. ..... 8/158; 68/20; 68/58

[51] Int. Cl.[2] ..... D06F 21/04; D06F 37/00

[58] Field of Search ..... 8/158, 159; 68/19, 20, 68/28, 58, 181 R, 205 R, 207

[56] References Cited

UNITED STATES PATENTS

| | | | |
|---|---|---|---|
| 1,077,330 | 11/1913 | Clarke | 68/20 |
| 1,740,716 | 12/1929 | Traube | 68/20 |
| 1,825,651 | 10/1931 | Barrett | 68/20 |
| 2,635,447 | 4/1953 | Van Dornick | 68/20 |
| 3,050,975 | 8/1962 | Pinder | 68/20 |
| 3,071,432 | 1/1963 | Geschka et al. | 8/159 |
| 3,099,022 | 7/1963 | Geschka et al. | 8/158 |
| 3,344,447 | 10/1967 | Candor et al. | 68/20 X |

*Primary Examiner*—Philip R. Coe
*Attorney, Agent, or Firm*—Frederick P. Weidner; Francis H. Boos

[57] ABSTRACT

A laundry machine and method for washing clothes having both a wash and extraction operation. There is included in the machine a rotatable drum for tumbling the clothes and liquid introduction means are provided for introducing liquid into the drum at the average rate of 0.5 to 3 gallons per minute during the wash operation. Means are also provided for producing a vacuum or negative pressure to withdraw the liquid from the drum during the wash operation at a rate sufficient to prevent a bath type washing action, then at the end of the wash operation stop the introduction of liquid into the drum and continue the negative pressure to withdraw the liquid during the extraction operation.

14 Claims, 9 Drawing Figures

LAUNDRY MACHINE AND METHOD OF WASHING CLOTHES

CROSS REFERENCE TO RELATED APPLICATION

This application is a continuation-in-part of copending patent application Ser. No. 464,223 for "Laundry Machine", filed Apr. 25, 1974, and now abandoned, in the names of Gerhard K. Losert and Laddie A. DePas, and assigned to the assignee of this application.

BACKGROUND OF THE INVENTION

1. Field of the Invention

This invention relates to laundry machines, more particularly to such machines that are combination washer-dryers, and to a method of washing clothes.

2. Description of the Prior Art

Combination washer-dryers are machines which provide for complete laundering of clothes, that is, they provide a washing operation which includes washing and rinsing, a centrifugal extraction or spin operation for removing a substantial part of the water from the clothes, after the wash operation, and a complete drying of the clothes, generally effected by tumbling the clothes in the presence of warm air. One of the difficulties with these combination washer-dryers is the method and apparatus necessary to extract the water after the washing operation. For instance, centrifugal extraction at high speeds which is desirable for maximum liquid removal forces liquid radially outward through the materials and has the effect of the clothes adhering to the inner surface of the clothes containing drum even after the drum ceases to rotate. Inasmuch as the heat drying of the materials is dependent upon their being tumbled so as to continually present different surfaces to the circulating air, it will be readily seen that, if the materials adhere to the container after the centrifugal operation, the necessary tumbling will not occur and drying will not be effected. Moreover, the entire machine must be constructed to withstand the very substantial forces involved in high speed rotation of a substantially but not necessarily balanced mass, as well as special speed transmission means being required to provide different speeds for washing and spinning.

Some machines have avoided this problem by removing the water from the drum by means of suction. One such laundry machine is shown in U.S. Pat. No. 3,050,975, assigned to the same assignee as the present invention, wherein after a bath type washing action is completed then a substantial amount of suction is operative at the bottom of the drum as it is rotated and after the liquid content of the clothes has been brought down, the regular heat drying operation is begun. That is, the clothes are tumbled in the rotating drum as warmed air is circulated through the clothes.

Another combination washer-dryer is shown in U.S. Pat. No. 3,344,447 wherein after or during the clothes within the drum have been subjected to a washing operation of the bath type, vacuum is drawn on the drum through a plurality of peripheral passageways that are connected to the interior of the drum and the wash water is extracted, then vacuum and/or heated air continues to dry the clothes for the remainder of the drying operation.

Flow through type washing machines and methods of washing clothes have been known, one of which is disclosed in U.S. Pat. No. 3,071,432 wherein a definite amount of water flows continuously into the washing liquid in the drum and an equal amount is discharged through an overflow. Such a method employs a bath-type washing action wherein the clothes being washed are submerged in the liquid during the washing operation. The dirty water of the upper layers of washing liquid bath is discharged or skimmed off. The amount of water must not be too great or the efficiency of the process is detrimentally affected owing to the increased consumption of washing agent and heat. U.S. Pat. No. 3,071,432, for instance, calls for an amount of water of between 0.08 to 0.15 liter per minute per kilogram of dry articles to be washed. For a 14 pound dry load of articles to be washed this would be a maximum amount of less than 1.5 quarts of water per minute.

One of the difficulties with combination washer-dryer laundry machines is that a long period of time is required for the complete sequential washing and drying operations. For a given amount of time more loads of clothes can be dried in a separate washer and dryer than in a combination washer-dryer for the simple reason that while one load is being dried another may be washing.

It is desirable to be able to have a combination washer-dryer laundry machine and method that will wash clothes well yet accomplishes the washing operation with less water and less detergent than a conventional washing machine. Such a laundry machine and method must also be efficient in operation, the machine must be low in manufacturing cost and economical to operate in order to also make it desirable.

By our invention all of the above desirable characteristics of a laundry machine and method of washing clothes may be achieved.

SUMMARY OF THE INVENTION

There is provided a laundry machine and method for washing clothes or the like having both a wash and extraction operation. The laundry machine has a rotatable drum for tumbling the clothes and means are provided for introducing liquid into the drum at an average rate of 0.5 to 3 gallons per minute during the wash operation. Means are also provided for producing a negative pressure to withdraw the liquid from the drum during the wash operation at a rate sufficient to prevent a bath type washing action, then at the end of the wash operation stop the introduction of liquid and continue the negative pressure to withdraw the liquid during the extraction operation.

It is an object of this invention to provide an improved laundry machine and method for washing clothes.

It is another object of this invention to provide a laundry machine and method for washing clothes which may also be utilized to subsequently dry the clothes.

It is another object of this invention to provide a laundry machine and method that will wash clothes with less liquid and detergent than standard automatic washing machines.

It is another object of this invention to provide a combination washing and drying laundry machine and method that will accomplish both the washing and drying operations within a reasonable amount of time.

DESCRIPTION OF THE PREFERRED EMBODIMENT

Figure 1:
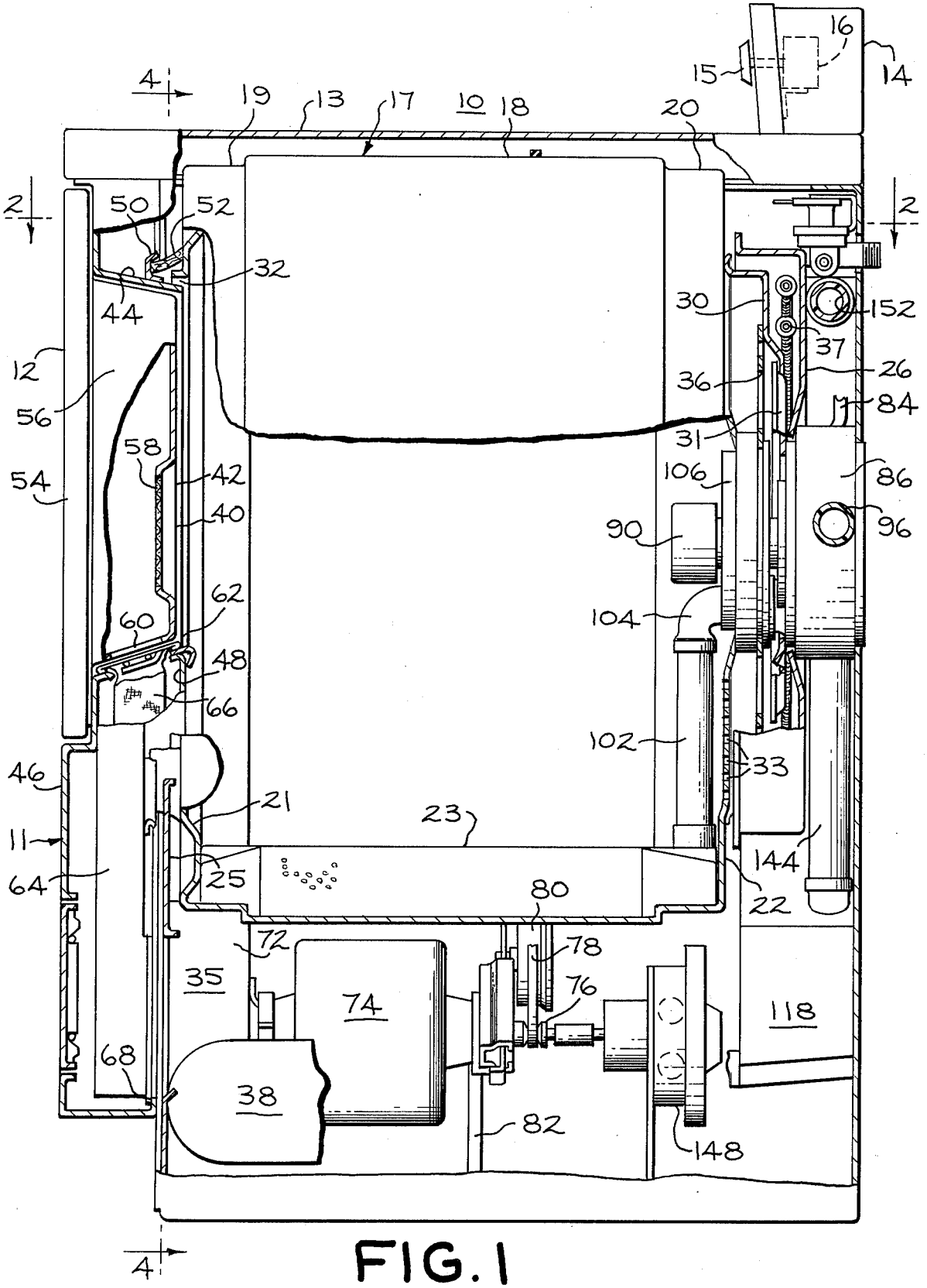
FIG. 1 is a side elevational view of a laundry machine incorporating the present invention, the view being partly broken away and partly in section to illustrate details.
Figure 2:
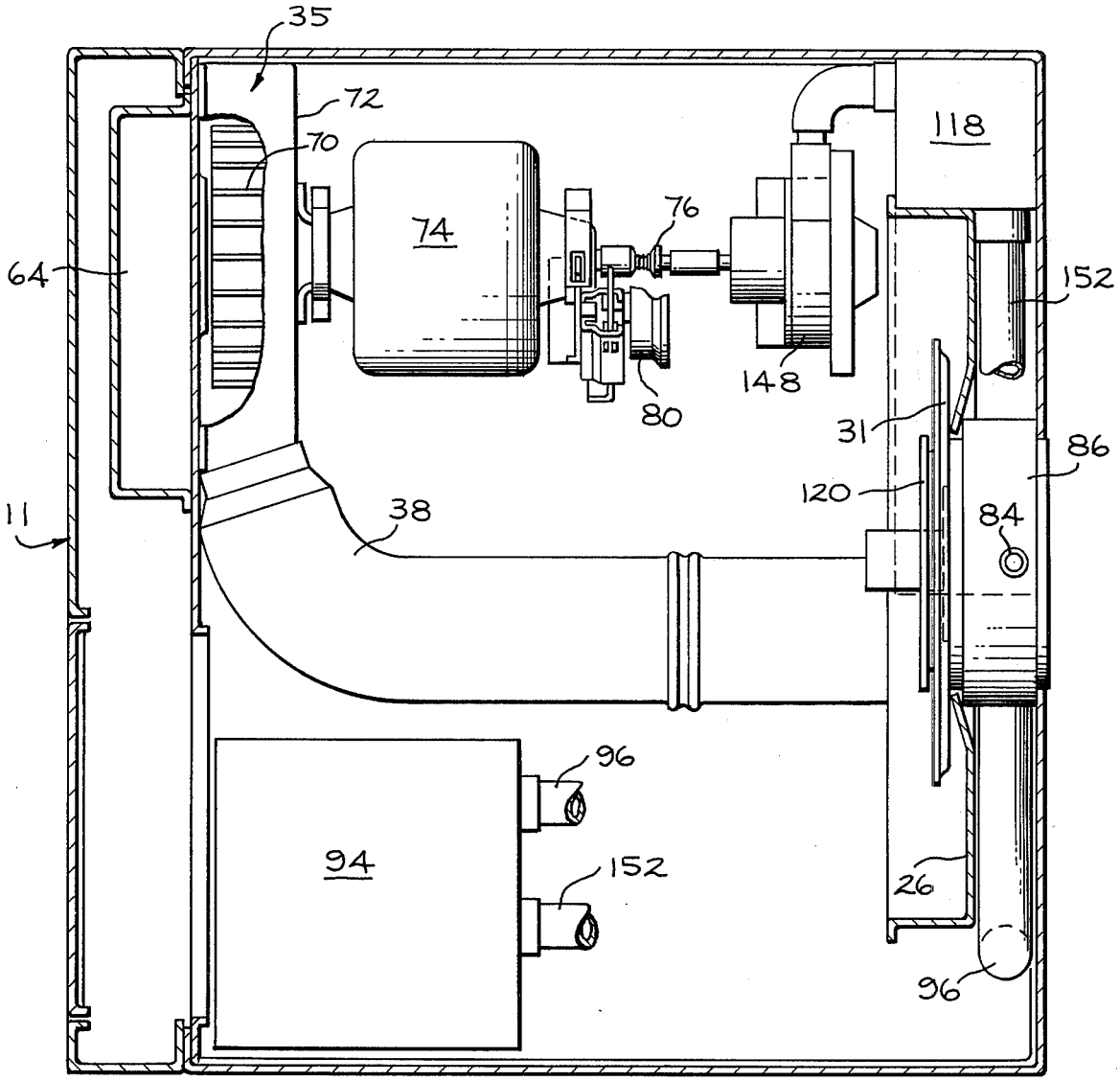
FIG. 2 is a view taken along lines 2—2 of FIG. 1 showing the laundry machine with the drum removed.

Referring now to the drawings and partially to FIGS. 1 and 2 thereof, there is illustrated a laundry machine 10 including an appearance and protective outer cabinet 11 having a door or closure 12 to provide access into the interior of the cabinet for loading and unloading fabrics. Provided on the top 13 of cabinet 11 is a control housing 14 which may, in a conventional way, include a suitable manual control 15 connected to a control assembly 16 mounted in the control housing 14. By manual setting of control 15, the machine may be caused to start and automatically proceed through a cycle operation including a wash, extraction and drying operation.

Within cabinet 11 there is provided a clothes tumbling container or drum 17 mounted for rotation on a substantially horizontal axis. Drum 17 is substantially cylindrical in shape, having a central cylindrical wall portion 18, and outer cylindrical wall portions 19 and 20, located respectively adjacent an annular front wall 21 and a circular rear wall 22 of the drum. Wall portions 18, 19 and 20 are imperforate while rear wall 22 has a plurality of perforations 33 and extend around the rear wall in an annulus. On the interior surface of cylindrical wall portion 18 there is a plurality of clothes tumbling ribs or baffles 23 so that clothes are lifted up when the drum rotates and then permitted to tumble back down to the bottom of the drum. These baffles also serve as part of the negative pressure apparatus as will be discussed more fully later. The front of the drum 17 may be rotatably supported within outer cabinet 11 by suitable slide members (not shown) secured to a bracket 25.

The rear end of drum 17 receives its support by means of a bearing arrangement 24 which is associated with the liquid introduction and removal apparatus as will be discussed more fully later.

Air baffle member 16 is ridigly secured to rear wall 28 of cabinet 11 and serves to support heater 37 which includes two electrical resistance heating elements **37*a* and 37*b* appropriately insulated from the air baffle member 26. Elements 37*a* and 37*b* may be annular in shape so as to be generally coextensive with perforations 33 in the rear wall 22 of drum 17. A ring baffle 30 is rigidly secured to the back wall 22 of the drum outside the ring of perforations 33 and within the stationary air baffle 26, so that an annular air inlet 34 is, in effect, formed by air baffles 26 and 30. The center portion of ring baffle 30 is cut out but essentially covered by a stationary louvered plate 31 that allows air to pass through but prevents liquid from the drum to enter the area of the heater 37. The ring baffle 30 and louvered plate 31 are slightly spaced from each other around the periphery of the plate 31 to allow relative rotational movement therebetween. In this manner a passage is formed for air to enter annular inlet opening 34 between the baffles, pass over the heater 37, through the louvers in plate 31 then pass through openings 36 formed in baffle 30, through perforations 33 in the rear wall 22 of drum 17** to the interior of the drum.

The front opening 32 of the drum is substantially closed by means of a stationary bulkhead generally indicated by the numeral 40. Bulkhead 40 is made up of a number of members including the inner surface 42 of access door 12, a stationary frame 44 formed as a flange on front wall 46 of the cabinet, the inner surface of an exhaust duct which is formed by the cooperation of member 48 and the front wall 46 of the cabinet, and an annular flange 50 mounted on the frame 44. It will be noted that a suitable clearance is provided between the inner edge of the drum opening 32 and the edge of bulkhead 40 so that there is no rubbing between the drum and the bulkhead during rotation of the drum. In order to prevent any substantial air leakage through opening 32 between the interior and the exterior of the drum, a suitable ring seal 52, preferably in the form of felt-like material, is secured to flange 50 in sealing relationship with the exterior surface of the drum.

Front opening 32, in addition to serving as part of the air flow path through the drum, also serves as a means whereby clothes may be loaded into and unloaded from the drum 17. Door 12, whose inner surface forms part of the bulkhead closing the opening, is mounted on cabinet 11 so that when the door is opened clothes may be inserted into and removed from the drum through the door frame 44. It will be noted that the door includes an outer, flat, imperforate section 54 and an inwardly extending hollow section 56 mounted on the flat outer section. Hollow section 56 extends into the door frame 44 when the door is closed, and the door surface 42 which comprises part of the combination bulkhead 40 is actually the inner wall of the hollow section.

The air outlet from the drum is provided by a perforated opening 58 formed in the inner wall 42 of hollow door section 56. The bottom wall section of door 12 and the adjacent wall of door frame 44 are provided with aligned openings 60 and 62, opening 62 providing the entrance to the duct 64 formed by the cooperation of member 48 with front wall 46. As shown, a lint trap 66 is positioned in the exhaust duct 64 at opening 62, the trap being supported by the door frame 44.

Duct 64 leads downwardly to an opening 68 which constitutes an opening into the blower 35 that has a bladed wheel 70 and a housing 72. The blower 35 is directly driven by an electric motor 74 as by mounting the wheel 70 on the shaft of the motor. The blower draws ambient air in over the heater 37, then through the drum 17, then through the door 12 and the duct 64, and then into the blower. From the blower the air passes through outlet duct 38 out of cabinet 11 so as to be exhausted from the rear of the machine.

In addition to driving blower wheel 70, motor 74 constitutes the means for effecting the rotation of drum 17. In order to effect this, motor 74 is provided with a shaft having a small pulley 76 mounted at the end thereof. A belt 78 extends around pulley 76 and also entirely around the cylindrical wall section 18 of drum 17. The relative circumferences of pulley 76 and wall section 18 causes the drum to be driven by the motor at a speed suitable to effect tumbling of the clothes therein when the pulley 76 is drivenly connected to the shaft of motor 74. In order to effect proper tensioning of belt 78, there may be provided a suitable idler assembly 80 secured on the same support 82 which secures one end of the motor. Thus, during the normal drying operation, air is pulled through the drum and, at the same time, the fabrics in the drum are tumbled. When the air is heated by heating elements 37*a* and 37*b*, the heated air passing through the drum causes vaporization of moisture from the clothes. The vapors are carried off with the air that passes out of the machine. Alternatively, rather than pass the air out of the machine it may be directed into and through condensing apparatus that lowers the temperature of the moisture-laden air thereby condensing out moisture from the air and then recirculate the air through the laundry machine.

It will be noted that the foregoing description of the laundry machine is very similar in structure and operation as a standard commercially available automatic clothes dryer. Within the above-mentioned structure there is incorporated also apparatus for washing clothes and it is to this aspect that this invention particularly relates. The following will be a description of the method and apparatus utilized in the washing operation and how liquid is introduced and extracted from the machine. Essentially the clothes are washed by placing them in the drum 17, closing access door 12 and manually setting the control 15 that starts the laundry machine through its cycled operations. Liquid from outside the machine, that is, fresh liquid, is introduced into the drum through a tubular conduit 84 that passes through a central stationary member 86 and into the center thereof where the conduit 84 terminates with the end 88 directed into the drum interior. A liquid diverting portion 90 having liquid flow passages 92 may be secured to the central stationary member 86 for distributing liquid introduced through tubular conduit 84 which is in the form of a stream. Once the clothes are saturated the liquid is withdrawn from the drum continuously through perforated baffles 23 as by a negative pressure, that is, a pressure less than the pressure of the atmosphere. The baffles 23 are hollow with the leading surface 108 having a plurality of perforations to allow liquid outside the baffle to pass into the interior of the baffle. By the leading surface it is meant that as the drum is rotated in the direction indicated by arrow A of FIG. 5, the leading surface 108 is the forward surface so that as liquid within the drum starts to accumulate then suction caused by the vacuum pressure system is exercised through perforations 110 to draw liquid into the interior of the baffle. There are three baffles 23 located equal distance around the interior of drum 17 and are secured to the drum interior surface. These active baffles 23 extend from the rear of the drum to the front of the drum and their shape may be most readily seen in FIG. 5. As can be seen in FIGS. 5–8, the vertical cross-section through the baffle shows the baffle to be generally triangular shaped and the ends of the baffles are somewhat wider and are secured at the front of the drum to outer cylindrical wall portions 19 and the rearward portion 100 is secured to the outer cylindrical wall portion 20. Connected to the rear portion 100 of each baffle is a pipe 102 which is rigid and extends from the baffle rear portion 100 up to an elbow 104 that is fixed to a connector plate 106 that is secured to the rear wall 22 of the drum 17 and rotates with the drum. As a result of the negative pressure or vacuum system, air and liquid are pulled through the clothes, through the perforations 110 of baffle 108, then into space 112 that extends from the forward outer cylindrical wall portion 19 to the rearward outer cylindrical wall portion 20 of the drum and is formed by the sides of the baffle including a floor panel 114 located within the baffle. It is preferable to have a baffle arrangement such that the perforated surface is in contact with the wet clothes as much as possible to enhance the suction action.

Figure 4:
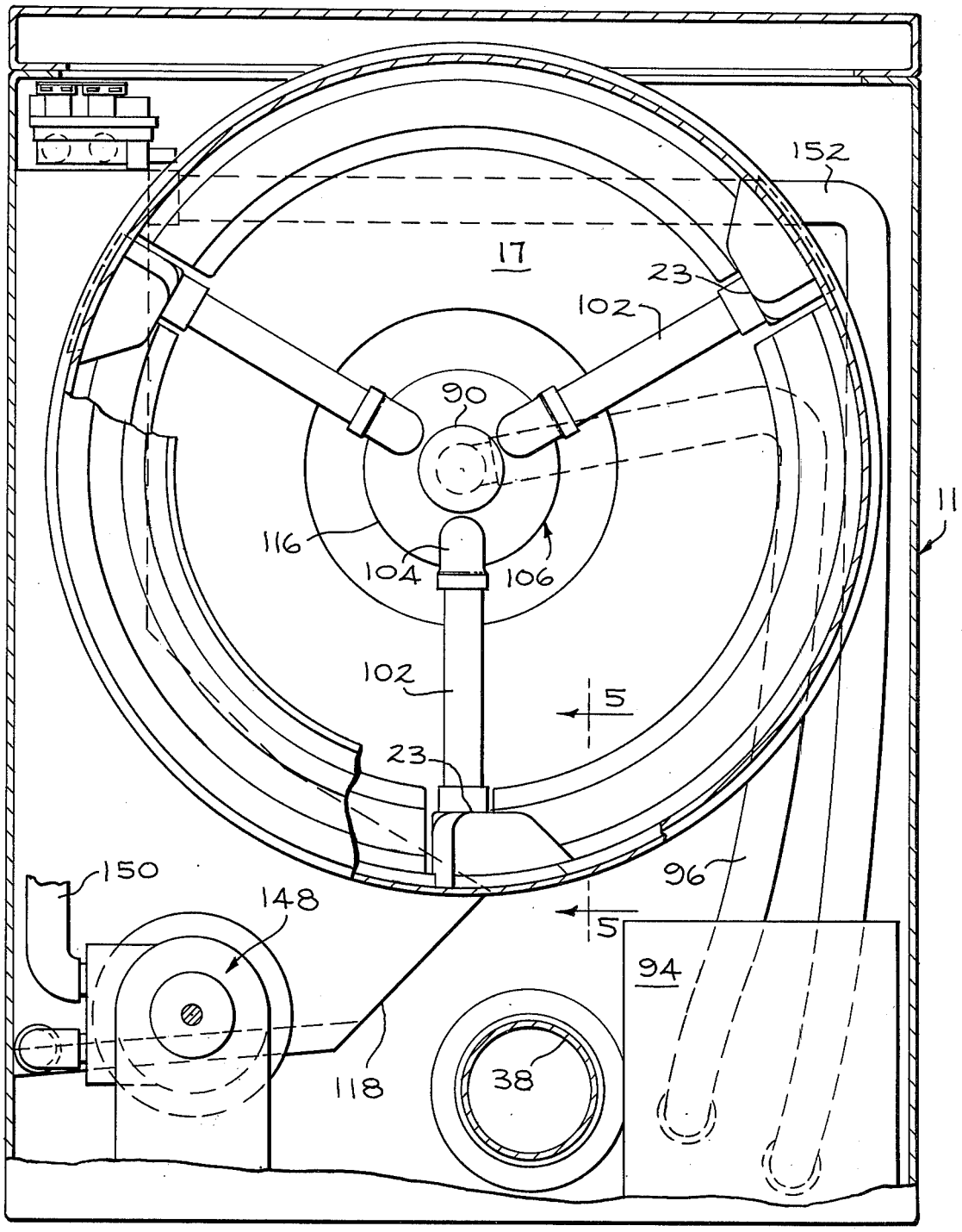
FIG. 4 is a front elevational view of the laundry machine taken along lines 4—4 of FIG. 1.
Figure 5:
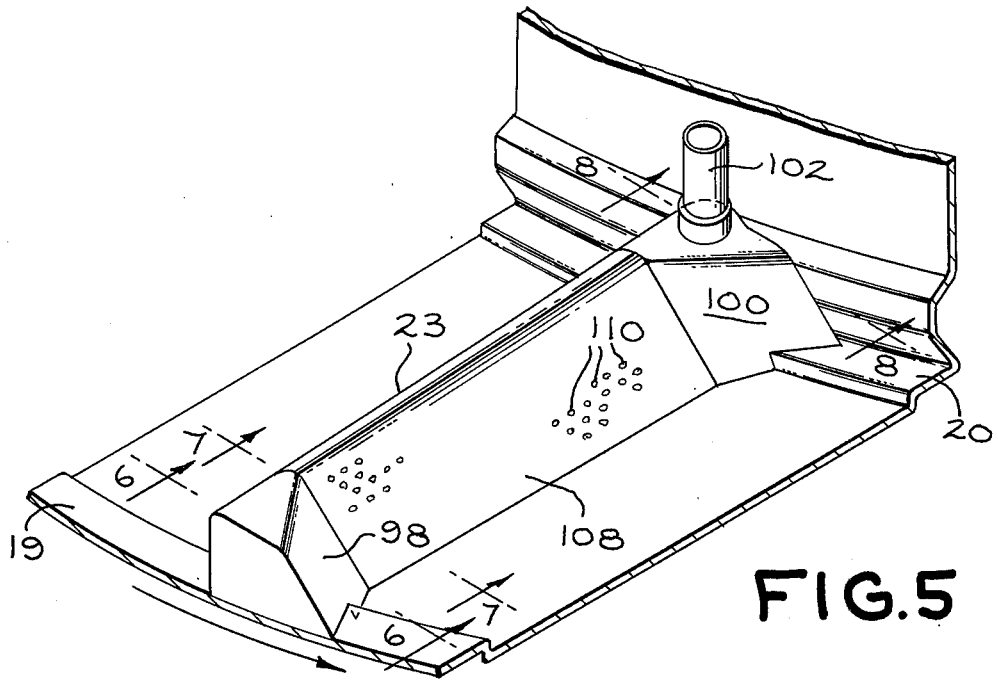
FIG. 5 is a partially cut away perspective cross-sectional view taken along lines 5—5 of FIG. 4 showing the drum baffle.
Figure 6:
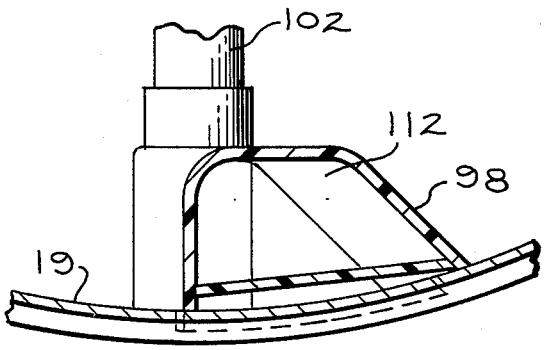
FIG. 6 is a cross-sectional view taken along lines 6—6 of FIG. 5.
Figure 7:
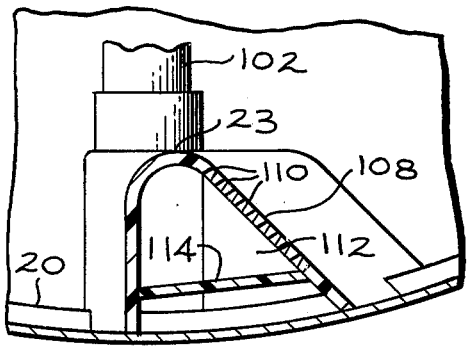
FIG. 7 is a cross-sectional view taken along lines 7—7 of FIG. 5.
Figure 8:
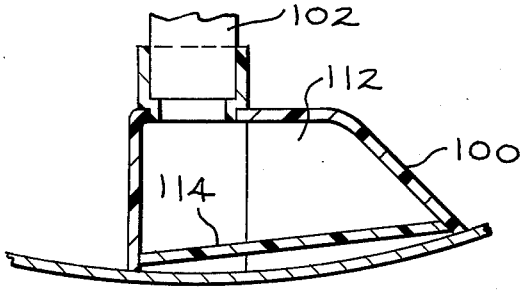
FIG. 8 is a cross-sectional view taken along lines 8—8 of FIG. 5.

The negative pressure arrangement of the machine is such that suction is applied to only one baffle 23 at a time and that is when it is passing through the lower portion of the circle scribed by the rotating drum. As viewed from the front of the machine with the drum rotating counterclockwise as shown in FIG. 4, suction would be applied to each baffle 23 as it moves angularly from about 7 to 3 O'clock on the circle. During this suction period air and liquid from the interior of the drum is drawn through pipe 102, elbow 104 into and through a hub 116 which is an integral part of connector plate 106. In order to remove the air and liquid from the drum, an air and liquid sealing arrangement is provided at the center of the rear wall 22 of the drum. This sealing arrangement includes several components that cooperate with each other to allow rotation of the drum yet provide for transfer of the air and liquid through the rear drum wall in a stationary separator 118 which will ultimately separate the liquid from the air so that the used liquid may be expelled from the machine. Secured to the central stationary member 86 is a face plate 120 that is laterally movable into and away from the rear wall 22 of the drum 17 for a short distance. The face plate 120 is continually urged or biased toward the drum by several compression springs 122 located radially around the central stationary member 86. The compression springs have their one end 124 seated in cavities 126 in the central stationary member 86 and the other end 128 abuts the rearward surface 130 of face plate 120.

Figures 3, 9:
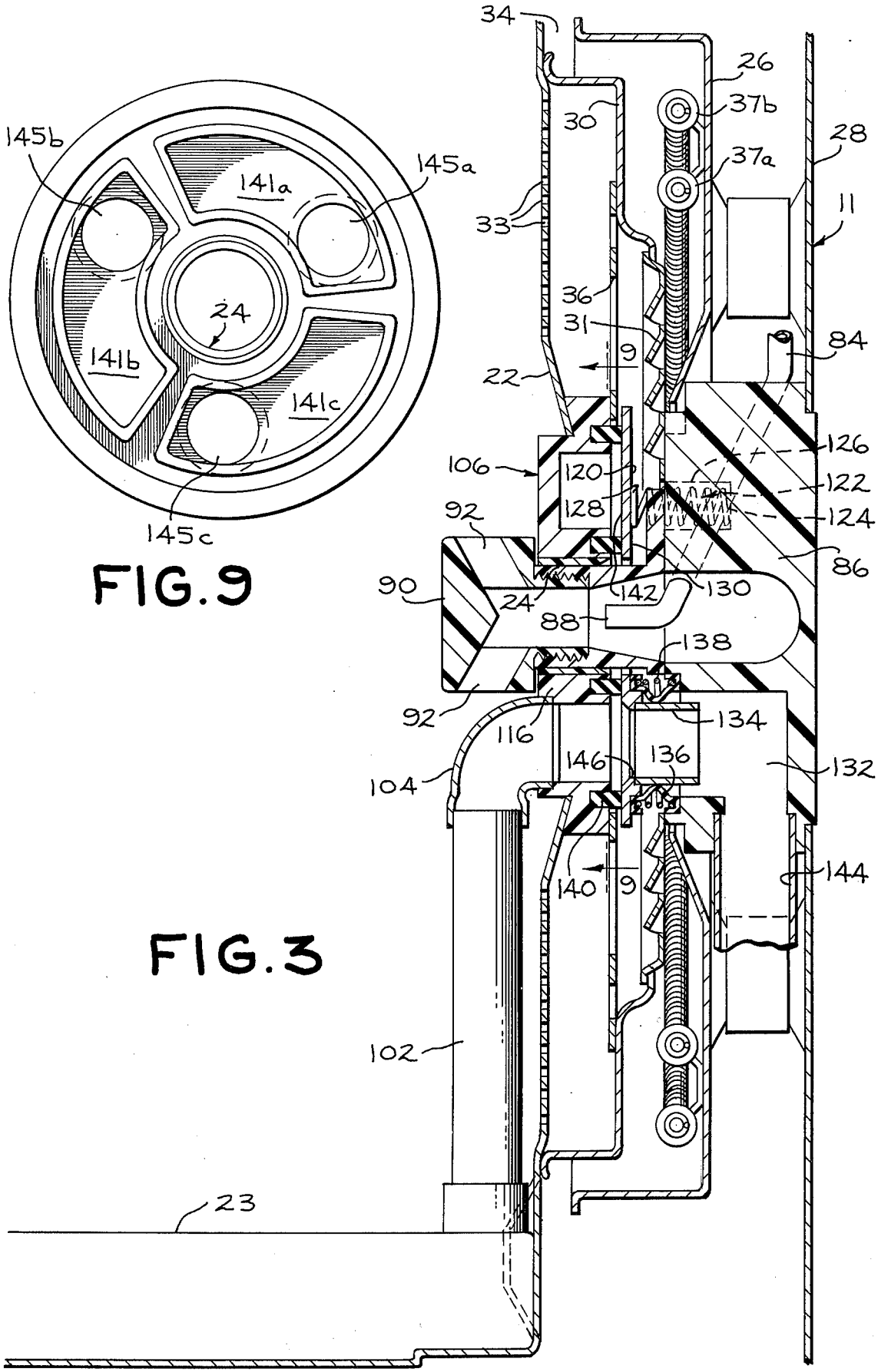
FIG. 3 is an enlarged cross-sectional view of a portion of the laundry machine of FIG. 1 showing the negative pressure transfer arrangement.
FIG. 9 is an enlarged view of the gasket arrangement taken along lines 9—9 of FIG. 3.

Central stationary member 86 secured to the rear wall 22 has formed therein a passageway 132 having a diameter sufficient to carry the air and liquid received from the active baffle 23. The passageway 132 has at the end closest to the center of the central stationary member 86 a short pipe 134 secured to the central stationary member 86. Surrounding the short pipe 134 is a gasket 136 and a compression spring 138 both of which are retained on the central stationary member 86 in a similar fashion as the arrangement of the other compression springs 122. This spring 138 also aids in urging the face plate 120 toward the rear of the drum. To effect air and liquid sealing between the rotating drum and specifically connector plate 106 and the stationary face plate 120 there is provided a gasket 140 that contacts the surface 142 of face plate 120 next to the rear wall 22 of the drum. The shape of the gasket 140 and the connector plate 106 in which it is rotationally carried is shown particularly in FIG. 9. The gasket 140 is divided into three sections 141*a*, *b* and *c* and is secured to connector plate 143 that has ports 145*a*, *b* and *c*, one for each section 141 of the gasket. By this arrangement then as the drum 17 is rotated face plate 120 is urged by compression springs 122 and 138 against gasket 140 so that they are in sliding sealing arrangement with respect to each other. As the rotating drum passes through the area of active suction during approximately one third of a drum revolution, liquid and air from inside the drum will be drawn through baffle space 112, pipe 102, elbow 104, one of the gasket sections 141, through a corresponding port 145, into the open end 146 of pipe element 134 whereupon it passes through the pipe element 134 and into passageway 132. From passageway 132 the air and liquid is drawn downwardly through a connecting pipe 144 into separator 118. Separator 118 is essentially a large sealed container that will, because of its volume, reduce the velocity of the air and liquid mixture so that the liquid is separated by gravity from the air and will drop to the bottom of the separator. Associated with the bottom of the separator 118 is a liquid pump 148 that will pump the liquid accumulated in the separator 118 through a hose 150 and remove the liquid from the laundry machine as by means of a normal household plumbing disposal system. It should be noted that preferably the liquid once used for washing the clothes in the drum is not reused.

Air from the separator 118 is directed by a hose 152 connected to the top of the separator back to the negative pressure producing means 94 and is returned to the drum via hose 96, then recycled through the system as previously described. The negative pressure producing means 94 is not shown in detail in the drawings as it is not necessary with regard to the invention but consists of a vacuum motor of the type commercially available and used for a variety of applications including vacuum cleaners. One such vacuum motor found satisfactory in the laundry machine produces about 60 cubic feet per minute at 2.5 inches of mercury.

The washing and extraction operations of the laundry machine and method of washing clothes will now be generally described. Soiled clothes are placed in the drum 18 through access door 12, then the machine turned on by operating manual control 15. By conventional control devices fresh liquid from a source external of the laundry machine, such as a household faucet, is introduced through a solenoid operated valve (not shown) into the interior of the drum through conduit 84. If desired, the motor 74 may be energized thereby causing drum 17 to rotate and tumble the clothes during the introduction of the liquid. At this time, a washing agent such as a detergent may be added by any suitable means (not shown). The introduction of liquid into the drum continues until the clothes are saturated at above 150%, by weight, liquid retention. By liquid retention it is meant that for a given clothes load by weight that the amount of liquid retained in the clothes is 1-½ times or 150% of the weight of the clothes. For instance, an 8 lb. load of clothes placed in the drum having a liquid retention of 150% means that the amount of liquid in the clothes will weigh 12 lbs. so that the total weight of the clothes plus the 150% liquid retained will equal 20 lbs.

Either during or shortly after liquid is being introduced into the drum the negative pressure or vacuum extraction apparatus is put into operation. That is, it can, if so desired, be put into operation after the clothes have become saturated above 150%, by weight, liquid retention to more quickly bring the clothes up to the desired saturation point thereby reducing the period of time necessary for the washing operation. As the liquid is being introduced into the drum or at least when it is being introduced after the clothes are saturated above 150%, by weight, liquid retention, the negative pressure producing means is energized so that the same amount of wash liquid is being constantly withdrawn during the washing operation as the amount of liquid being introduced. In this manner while this is a flow through type washing operation wherein fresh liquid is introduced and used liquid removed and discharged from the drum, the clothes being washed are essentially sopping wet but a bath type washing action where the clothes are submerged in the liquid is not employed. This aspect of the invention is important as otherwise the desirable characteristics of the laundry machine and method of washing clothes are not achieved. Since the used free liquid, which is not in the saturated clothes, is removed from the drum quickly and not accumulated in a bath, redeposit of the removed soil back into the clothes is kept to a minimum during the washing operation.

It should also be noted that with a relatively small amount of liquid being introduced into the drum during the washing operation the detergent added at the beginning of the washing operation provides a greater concentration of detergent during the washing operation when it is advantageous. That is, at the beginning of the washing operation when the clothes have the greatest amount of soil. This initial high detergent concentration in the liquid and sucking that liquid through the clothes together and quick removal of the used free liquid from the drum in our washing method contributes to a good washing action.

As the drum 17 rotates counter-clockwise, as viewed from the front of the laundry machine, the clothes fall to the bottom of the drum at which time the active baffle 23 in the lower portion of its rotation scribing circle (between 7 and 3 O'clock) sucks the wash water from the drum and through baffle 23, pipe 102, elbow 104, gasket section opening 141, rigid plate opening 145, pipe element 134, and then through passageway 132 into separator 118. Within separator 118 the dirty wash liquid at the bottom is removed by a pump 148 while the air is removed from the separator through air hose 152 back to the negative pressure producing means 94. After a period of time, usually from 14 to 26 minutes, depending upon the type and amount of clothes to be washed the laundry machine control timer automatically stops the flow of incoming fresh liquid but the negative pressure continues until the liquid retention of the clothes is reduced to below 150%, by weight. At this time the washing operation is completed. It should be understood that the rate of fresh liquid introduced into the drum may be varied during the washing operation such as at the beginning in order to bring the clothes saturation up to at least 150%, by weight, liquid retention as quickly as possible and near the end of the washing operation to enhance rinsing of the clothes. It has been found that if the average rate of liquid introduced into the drum is between 0.5 to 3 gallons per minute and preferably between 0.75 and 1.5 gallons during the wash operation then good washing characteristics are achieved yet with less total liquid needed as compared to a standard commercially available automatic washing machine. If less than 0.5 gallons per minute is introduced the washing action is detrimentally affected. If more than 3 gallons per minute is utilized there is no increased washing action accomplished and the equipment necessary to accommodate this larger amount of liquid is more costly and thereby makes the machine much less economical to operate. With less liquid being used less detergent is needed to maintain the desirable detergent concentration during the washing operation. Moreover, we have found that it is possible to reduce the amount of time needed for the washing action thereby making a combination washer and dryer laundry machine more desirable than such machines heretofore. All of the foregoing is achieved yet the laundry machine is relatively low in cost and is economical to operate.

It will be understood that in a combination washer-dryer laundry machine after the completion of the washing operation then the drying operation takes place. This consists of the control automatically energizing the heating element 37 while the drum is continued to be rotated and the heated air in the system is circulated by blower 35 through the tumbling clothes. The moisture-laden air from the drum passes through the bulkhead 40 down through the openings 60 and 62 through lint trap 66, air duct 64 and then expelled from the machine through duct 38 that passes through cabinet 11. Alternatively, rather than expelling the moisture-laden air outside the machine there may be included in the machine a condensing apparatus wherein the moisture-laden air from the clothes is introduced into the apparatus and the temperature of the air lowered thereby condensing out moisture from the air, then the air recirculated through the clothes dryer again.

The foregoing is a description of the preferred embodiment of the invention and variations may be made thereto without departing from the true spirit of the invention, as defined in the appended claims.

What is claimed is:

1. A laundry machine of the liquid flow through type having both a wash and extraction operation comprising:

a. a rotatable drum for tumbling clothes therein,
b. means for continuously introducing fresh liquid into the drum at an average rate of 0.5 to 3 gallons per minute during the wash operation,
c. means for continuously producing a negative pressure to continuously withdraw the liquid from the drum during the wash operation at a rate sufficient to prevent a bath type washing action,
d. means to continuously discharge the withdrawn liquid to an external drain, and
e. means to stop the introduction of fresh liquid at the end of the wash operation and continue the negative pressure to withdraw liquid from the drum during the extraction operation.

2. The laundry machine of claim 1 wherein the fresh liquid introduced into the drum is at an average rate of 0.75 to 1.5 gallons per minute during the wash operation.

3. The laundry machine of claim 1 wherein the means for introducing fresh liquid into the drum and the means for producing the negative pressure to withdraw the liquid from the drum cooperate with each other so that the clothes are saturated at above 150%, by weight, liquid retention.

4. The laundry machine of claim 1 wherein means are provided for introducing a washing agent at the beginning of the wash operation.

5. The laundry machine of claim 1 wherein the drum has a cylindrical wall rotatable about a horizontal central axis, the interior of the drum having a perforated baffle in air flow communication with the negative pressure producing means.

6. The laundry machine of claim 1 wherein the means to continue the negative pressure to withdraw the liquid during the extraction operation is continued until the liquid retention of the clothes is reduced to below 150%.

7. A laundry machine of the liquid flow through type for washing clothes having both a wash and extraction operation comprising:

a. a rotatable drum for tumbling clothes therein,
b. means for continuously introducing fresh liquid into the drum at an average rate of 0.5 to 3 gallons per minute during the wash operation,
c. means for continuously producing a negative pressure to continuously withdraw the liquid from the drum during the wash operation at a rate sufficient to prevent a bath type washing action, said liquid introducing means and withdrawal means cooperating with each other so the clothes are saturated at above 150% by weight, liquid retention,
d. means to continuously discharge the withdrawn liquid to an external drain, and
e. means to stop the introduction of liquid at the end of the wash operation and continue the negative pressure to withdraw liquid from the drum during the extraction operation to reduce the liquid retention of the clothes to below 150%.

8. The laundry machine of claim 7 wherein the drum has a cylindrical wall rotatable about a horizontal central axis, the interior of the drum having a perforated baffle in intermittent air flow communication with the negative pressure producing means through a seal rotated with the drum.

9. The laundry machine of claim 7 wherein the liquid introduced into the drum is at an average rate of 0.75 to 1.5 gallons per minute during the wash operation.

10. A method of washing clothes by performing both a wash and a subsequent extraction operation in a machine having a rotatable drum and a negative pressure producing means comprising the following steps:

a. tumbling clothes in the rotatable drum,
b. continuously introducing fresh liquid into the drum at an average rate of 0.5 to 3 gallons per minute during the wash operation,
c. continuously withdrawing the liquid from the drum during the wash operation by means of a negative pressure producing means at a rate sufficient to prevent a bath type washing action,
d. continuously discharging the withdrawn liquid to an external drain,
e. stopping the introduction of fresh liquid at the end of the wash operation, and
f. continue maintaining operation of the negative pressure producing means to withdraw liquid from the drum during the extraction operation.

11. The method of washing clothes in accordance with claim 10 wherein introducing fresh liquid into the drum is at an average rate of 0.75 to 1.5 gallons per minute during the wash operation.

12. The method of washing clothes in accordance with claim 10 wherein introducing fresh liquid into the drum and withdrawing the used liquid from the drum is controlled with respect to each operation so that the clothes are saturated at above 150%, by weight, liquid retention.

13. The method of washing clothes in accordance with claim 10 wherein maintaining the negative pressure during the extraction operation is continued until the liquid retention of the clothes is reduced to below 150%, by weight.

14. The method of washing clothes in accordance with claim 10 wherein a washing agent is introduced at the beginning of the wash operation.

* * * * *